US005941641A

United States Patent [19]

Kinigakis et al.

[11] Patent Number: 5,941,641

[45] Date of Patent: Aug. 24, 1999

[54] WRAP-AROUND RECLOSEABLE POUCH

[75] Inventors: Panagiotis Kinigakis, Princeton Junction, N.J.; Joseph L. Gregory, III, Richmond, Va.

[73] Assignee: Kraft Foods, Inc., Northfield, Ill.

[21] Appl. No.: 09/073,977

[22] Filed: May 7, 1998

[51] Int. Cl.[6] ..... B65D 33/16

[52] U.S. Cl. ..... 383/86; 383/61; 383/63; 383/905; 206/260

[58] Field of Search ..... 383/84, 86, 85, 383/905, 61, 63; 206/260

[56] References Cited

U.S. PATENT DOCUMENTS

| | | | |
|---|---|---|---|
| 2,248,579 | 7/1941 | Moore | 206/260 X |
| 2,373,285 | 4/1945 | Baer | 206/260 X |
| 2,506,311 | 5/1950 | Moore | 206/260 X |
| 2,536,773 | 1/1951 | Saidel . | |
| 3,150,813 | 9/1964 | Wellman | 383/905 X |
| 3,201,030 | 8/1965 | Pollack . | |
| 3,246,833 | 4/1966 | Schlienz et al. | 383/86 X |
| 3,613,874 | 10/1971 | Miller . | |
| 3,618,850 | 11/1971 | Palmer . | |
| 4,505,385 | 3/1985 | Focke et al. . | |
| 4,584,201 | 4/1986 | Boston . | |
| 4,603,537 | 8/1986 | Pace . | |
| 4,691,370 | 9/1987 | MacFee . | |
| 4,711,349 | 12/1987 | Focke et al. . | |
| 4,786,190 | 11/1988 | Van Erden et al. . | |
| 4,824,261 | 4/1989 | Provost . | |
| 4,898,280 | 2/1990 | Runge . | |
| 4,925,316 | 5/1990 | Van Erden et al. . | |
| 4,936,817 | 6/1990 | Runge . | |
| 4,955,981 | 9/1990 | Provost . | |
| 5,244,136 | 9/1993 | Collaso . | |
| 5,328,436 | 7/1994 | Larsen et al. . | |
| 5,366,087 | 11/1994 | Bane . | |
| 5,392,974 | 2/1995 | Johnson-Rabbett . | |
| 5,582,889 | 12/1996 | Pedrini . | |

*Primary Examiner*—Jes F. Pascua

*Attorney, Agent, or Firm*—Thomas R. Savoie; Thomas A. Marcoux

[57] ABSTRACT

A flexible pouch is provided which includes a flexible product-confining compartment that is folded upon itself. The compartment has a closure assembly adjacent to its mouth, and a wrap-around flexible flap extends above or beyond the mouth. A deadfold strip is associated with the flexible flap such that the flexible flap can wrap partially or entirely around the compartment, depending primarily upon the amount of product within the compartment, with the compartment also folded on itself in response to the amount of product within the compartment.

23 Claims, 2 Drawing Sheets

WRAP-AROUND RECLOSEABLE POUCH

BACKGROUND OF THE INVENTION

This invention generally relates to a flexible pouch which is able to closely accommodate a product of a type which reduces in size during use, the pouch being capable of tightly wrapping around the product whether it entirely fills the pouch or only partially fills the pouch. More particularly, the pouch container or compartment includes an openable and closeable assembly such as a strip of interlocking profiles in order to permit selective access to the pouch. A flexible flap extends well beyond this openable and closeable assembly, and a deadfold strip is positioned on this flexible flap. Especially when the pouch is not completely full, a portion of the pouch combines with the flap in order to provide a wrap-around portion which closely overlies one side and at least a portion of an opposite side of the closed pouch compartment, with the deadfold strip maintaining this wrapped-around configuration. The extended flap with deadfold strip, when partly or fully opened, provides a convenient pallet for dosing portions of the product.

Heretofore, deadfold strips have been used in folding over portions of packages which are below the entry side or mouth of the package or bag. Then, when an empty portion of the bag is folded onto itself, the deadfold strips serve to maintain that fold. Examples of this type of an approach include U.S. Pat. No. 5,215,797 and No. 5,328,436, their disclosures being incorporated hereinto by reference. With these types of approaches, the security of the reclosure can be unsatisfactory inasmuch as it is achieved by merely folding over the portion of the package which is below or inside of the mouth and then having the deadfold strip be the only means for maintaining the fold. Accordingly, while this deadfold approach is useful, it does not by itself provide an especially secure and effective seal of the package.

It is also generally known that pouches can be provided for enclosing certain products and for having components which exhibit a general wrap-around approach in order to provide a package which generally reduces in size as the contents of the package are used up. References such as U.S. Pat. No. 2,536,773 show such a pouch arrangement. In this particular teaching, sealing is attempted by using a highly plasticized polymer which has a self-sealing property. Approaches of this type bring with them the problem that highly plasticized polymers, or adhesives, and the like, would provide a risk of products, especially particulate products, adhering to this tacky type of surface. This can be a particular concern if the materials within the package are food products which could become contaminated by the tacky polymer or adhesive.

Accordingly, it would be advantageous to have a pouch type of package which can be opened and securely reclosed while also closely accommodating products which reduce in volume as they are used, such as when a dose of a multi-dose product is removed from the package. The partially or fully opened flap provides a convenient pallet. With such an approach, the consumer would have full control over the product-containing volume of the pouch without having to compromise on the effectiveness of the resealing capabilities, including those provided by sealing means such as zip closures.

SUMMARY OF THE INVENTION

In accordance with the present invention, a flexible pouch is provided which is especially suitable for containing a particulate product which typically is consumed or used in increments or doses. Such a pouch includes a flexible product-confining enclosure or container which can be filled or partially filled with product and foldable upon itself so as to define a variety of product-confining volumes. The pouch includes a mouth and a selectively openable and closeable assembly such as one having mating profiles. Extending outwardly from this mouth is a wrap-around flexible flap having a deadfold strip. After product is removed from the package compartment through the open recloseable assembly and the mouth, the recloseable assembly is then closed, and a portion of the flexible compartment is folded over onto the compartment which now has been reduced in size. At the same time, the flexible flap which extends beyond or above the mouth provides a continuation of the thus-wrapped and folded compartment until the entirety of the flexible flap closely overlies and wraps around at least a portion of the reduced-in-size compartment. Typically, a portion of the flexible flap lies along one surface of the compartment enclosure, while another portion of the flexible flap lies along an opposing portion of the flexible compartment enclosure. The deadfold strip maintains this wrapped configuration and enhances the secureness of the closure by combining a recloseable strip with a wrap-around arrangement which is secured by a deadfold strip.

It is accordingly a general object of the present invention to provide an improved flexible pouch which reduces in closure volume as product is removed from the pouch package.

Another object of the present invention is to provide an improved flexible package which is especially suitable for particulate products, particularly particulate food products.

Another object of this invention is to provide an improved flexible pouch-like container having a particulate product therewithin and a zip-strip reclosure assembly for maintaining secure reclosure after particulate product is removed from the pouch.

Another object of the present invention is to provide an improved flexible pouch able to accommodate numerous dosed usages by the consumer wherein the consumer has complete control of the folding height of a pouch flap.

Another object of this invention is to provide an improved flexible pouch which allows continuous adjustability of folding height as product is used, by changing the location of folding or pinching of the package.

Another object of the present invention is the ability to provide a pouch which is tailored for the particular product and pouch material by incorporating deadfold strips which are customized with respect to configuration and gauge of wire, distance between the wires, and coating or coating blend types.

These and other objects, features and advantages of the present invention will be apparent from and clearly understood through a consideration of the following detailed description.

BRIEF DESCRIPTION OF THE DRAWINGS

In the course of this description, reference will be made to the attached drawings, wherein.

DESCRIPTION OF THE PREFERRED EMBODIMENTS

Figure 1:
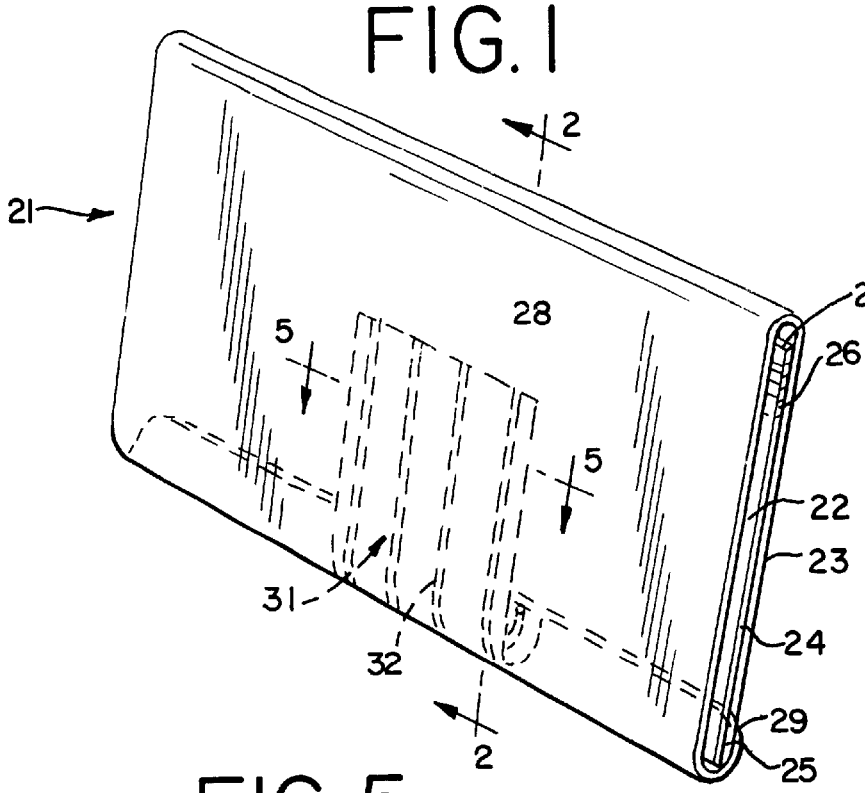
FIG. 1 is a perspective view of a package according to the present invention, shown in its maximum height closed configuration.

The present invention exhibits the overall form of a pouch, generally designated at 21 in FIG. 1. Pouch 21 has an overall wrap-around characteristic such that an elongated component which does not contribute to the capacity of the pouch wraps around that portion of the pouch having storage capacity, the extent of the wrapping varying depending upon the quantity or volume of product within the product-holding compartment of the pouch. In this way, the overall height of the pouch reduces as the product is removed from the compartment. In addition, means are provided for easily and securely maintaining the wrapped-around position of the flap portion which does not contribute to the product-containing capacity of the pouch.

With more particular reference to the illustrated pouch 21, it includes a flexible product-confining compartment 22, defined between opposing flexible sheets 23, 24. Preferably, a gusset structure 25 is provided in the bottom of the compartment 22. In addition, a selectively openable and closeable assembly 26 is provided at the top portion of the compartment 22. Assembly 26 is of a type which includes mating profiles. A typical structure in this regard is a so-called zip closure. It win be appreciated that zip closures can encompass many different types of profiles, as is appreciated by those in the art. Whatever the profile, the selectively openable and closeable assembly 26 is readily opened by pull-apart or unzipping digital forces in order to gain access to the compartment. It is also readily closeable by mating the profiles together along the length of the assembly 26. This selectively openable and closeable assembly 26 is positioned below or interior of the mouth opening 27 of the compartment 22. With this arrangement, the user gains access to the compartment 22 by opening the mouth 27 in order to thereby open the selectively openable and closeable assembly 26 and thus gain access to the interior of the flexible product-confining compartment 22.

A wrap-around flexible flap 28 extends above or outwardly of the mouth 27. Typically, this wrap-around flexible flap 28 will be integral with the compartment 22. In the illustrated embodiment, the flap 28 is an extension of the flexible sheet 23 and thus is formed with the compartment 22 when the flexible pouch 21 is assembled. In the illustrated embodiment, the wrap-around flexible flap 28 has an overall height from the mouth 27 to a free end 29 of the flap 28 which is greater than the height of the flexible product-confining compartment 22 when that compartment is full of product and not folded on itself and/or wrapped around. In this way, the compartment 22 is partially or fully wrapped by the flap 28 in all or most of the configurations of the flexible pouch 21.

In an important aspect of the invention, the wrap-around flexible flap 28 includes a deadfold strip 31. One or more such strips can be included. In the illustrated embodiment, the deadfold strips 31 include four readily bendable, non-elastic rods 32. These are made of a material which, when folded, typically in a curve, remains so folded or curved. This feature imparts to the strip(s) 31 the ability to readily be conformed to a wrapped-around configuration of the wrap-around flexible flap 28 and then to retain that configuration so as to maintain the wrapped-around positioning of the flexible flap 28. Without the deadfold strip(s), the flexible flap could be wrapped-around, but it would not remain in place and thus wrapped-around without another component, such as a rubberband, piece of tape, piece of string, and the like.

Figure 5:
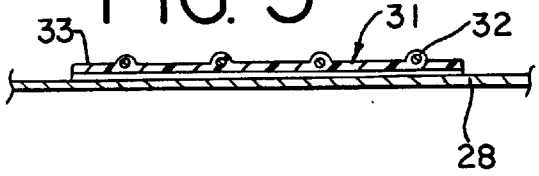
FIG. 5 is a partial cross-sectional view of FIG. 1, taken along the line 5—5 of FIG. 1.

In the illustrated embodiment, each of the deadfold strip(s) 31, as perhaps best seen in FIG. 5, includes a flexible strip 33 within which is embedded one or more rod(s) 32. Rod 32 is made of a polymeric or metal material which exhibits the bendable, non-elastic properties described above. These materials are considered to be ductile. These ductile materials have the characteristic of withstanding repeated closing and reclosing without changing or substantially reducing the mechanical and physical properties of the deadfold strip(s). The strips may be round, square or flat in cross-section. Typical deadfold strips are described in the aforementioned U.S. Pat. No. 5,215,797 and No. 5,328,436.

Figure 8:
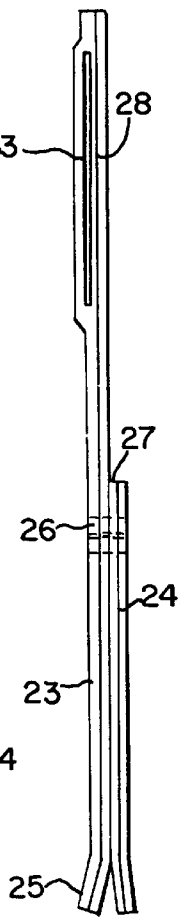
FIG. 8 is an end elevational view of another embodiment.

In the embodiment of FIG. 1 through FIG. 6, one or more separate flexible strips 31 are adhered to what is the inside surface of the flap 28 when it is wrapped against the flexible product-confining compartment 22. The inside surface is on the same side of the pouch as is the mouth 27. In the embodiment shown in FIG. 7, one or more flexible strips 31*a* are secured to the outside surface of the flap 28. In the embodiment of FIG. 8, one or more flexible strips 33 are embedded within at least a portion of the wrap-around flexible flap 28.

FIG. 8 also illustrates that each of the sheets 23, 24 and the wrap-around flexible flap 28 can be a laminate of more than one film. In a preferred arrangement, the laminate incorporates a polymer and a metallic or metallized foil, often secured together by a suitable adhesive or the like. Other suitable laminates include those combining polymer, foil and paper or other cellulosic material. Whatever film materials are used, suitable side seals 34, 35 are provided in a generally known manner (e.g. heat sealing, pressure sealing, etc.).

It is possible to customize the bendable non-elastic rods and the flexible strip of the deadfold components in order to match the material of the remainder of the pouch and the requirements of the pouch and product. Variables include gauge and spacing of the rods, the weight or thickness of the flexible strip or coating, and the polymer of the strip or coating. For example, it can be desirable to have the flexible strip or coating match the polymer of the rest of the pouch or to at least choose a material for the strip or coating of the deadfold strip which is fully compatible with the material of the remainder of the pouch.

Figure 2:
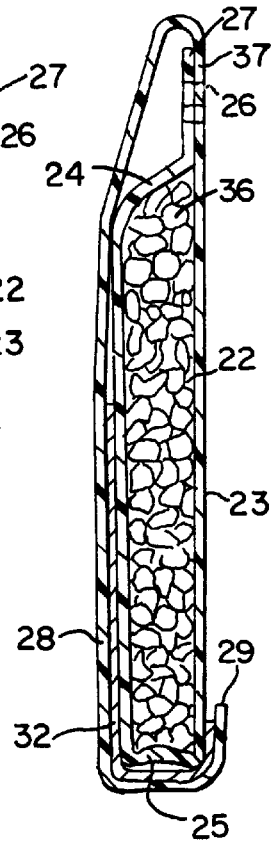
FIG. 2 is a cross-sectional view along the line 2—2 of FIG. 1.

Referring more particularly to the fold-over and wrap-around aspects of the invention, FIG. 2 illustrates a situation wherein the flexible product-confining compartment 22 is filled with particulate product 36. In this illustrated arrangement, this product is composed of a plurality of particles. Shredded cheese is a typical product which is reduced in volume as the product is removed from the compartment 22 through the mouth opening 27. Other products suitable for use with this invention are: gum, candy and tobacco. Ideally, only the desired dose amount of product is removed from compartment 22 by the consumer. Of course, if excess product is removed, it may be returned to compartment 22 for later doses.

In the FIG. 2 configuration, it will be noted that the deadfold strip 31 has wrapped along the bottom of the compartment in the vicinity of the gusset 25. Because of the ductile properties of the rod(s) 32, this wrapped-along configuration is maintained during handling and storage of the pouch 21. When it is desired to gain access to the compartment 22, the deadfold strip 31 is unfolded to whatever extent is needed or desired such that the free end 29 clears the bottom of the compartment 22, allowing the flap 28 to be moved out of its location shown in FIG. 2 at which the flap 28 obstructs access to the mouth 27. At that time, the mouth 27 can be opened, and the selectively openable and closeable assembly 26 can likewise be opened, after which a portion of the product 36 can be removed from the compartment.

Figure 3:
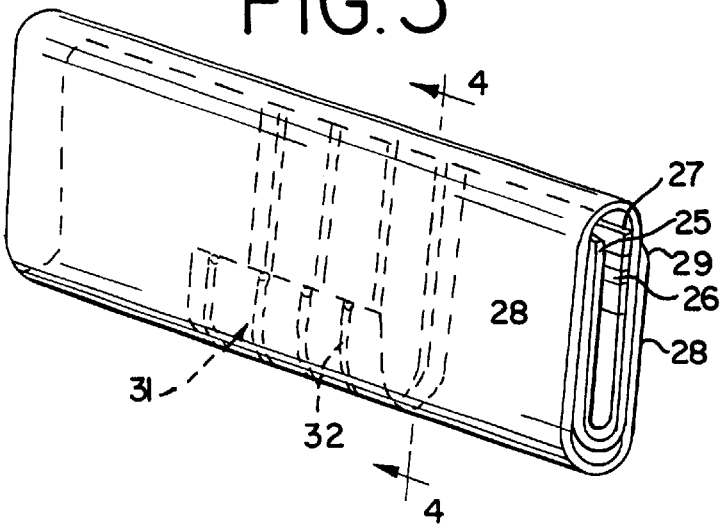
FIG. 3 is a perspective view of the package of FIG. 1, shown in a wrapped-around configuration by which the product-accommodating volume of the package is reduced from that shown in FIG. 1.
Figure 4:
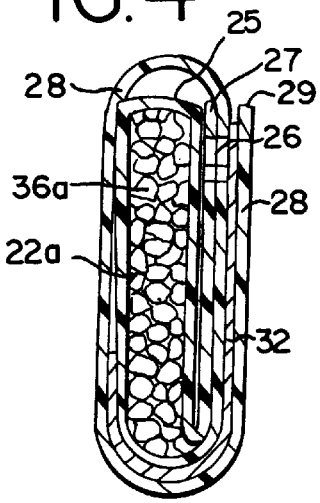
FIG. 4 is a cross-sectional view along the line 4—4 of FIG. 3.

Referring now to FIG. 3 and FIG. 4, this illustrates a wrapped-around condition which is more enclosing than the FIG. 2 wrapped-along configuration of the pouch 21, which is made possible after a substantial proportion of the product 36 as shown in FIG. 2 has been removed from the compartment. The remaining product 36*a* fills only a portion of the now reduced-size compartment 22*a*. It will be noted that this reduction in size is a reduction in volume that is caused by a reduction in the height of the compartment from the height of compartment 22 of FIG. 2 to the height of compartment 22*a* of FIG. 4. Because of this reduction, the wrap-around flexible flap 28 and the deadfold strip(s) 31 are able to cover a greater outside area of the compartment 22*a*. In the embodiment shown in FIG. 4, the flexible flap 28 is able to wrap completely around the reduced-height product-confining compartment 22*a*. It will be noted that the deadfold strip 31 and product-confining compartment 22*a*. It will be noted that the deadfold strip 31 and its ductile rods 32 curve at a location different from that shown in FIG. 2, this location being farther away from the free end 29.

At the configuration of FIGS. 3 and 4, the compartment 22*a* has a reduced interior space which corresponds to the remaining product 36*a*, thereby reducing the contact of the product with air or moisture which might otherwise be present in the compartment 22 if the full size of that compartment were maintained, rather than the reduced size which is evident from FIG. 4. In addition, the fully wrapped-around characteristic of this configuration provides additional protection to the product-confining compartment 22*a* and the product therewithin, while also providing a pouch which is reduced in size and thus more easily stored. In effect, the compartment is tightly wrapped about the remainder of the product 36*a*, and the compartment is subjected to "pinch" folding onto itself.

It will be appreciated that, with the present invention, any number of differently sized product-confining compartments can be configured by folding and wrapping. In addition, size, volume or height is characteristically automatically determined by the amount of product remaining after same is removed from the compartment by the consumer or user. In certain instances, such as when the quantity of product within the compartment is even further reduced from that shown in FIG. 4, the flexible flap 28 will wrap around even farther than shown in FIG. 4, to the extent that the flap will wrap around itself. Even in those instances, each deadfold strip allows that configuration of even further reduced height to be maintained as desired.

Figure 7:
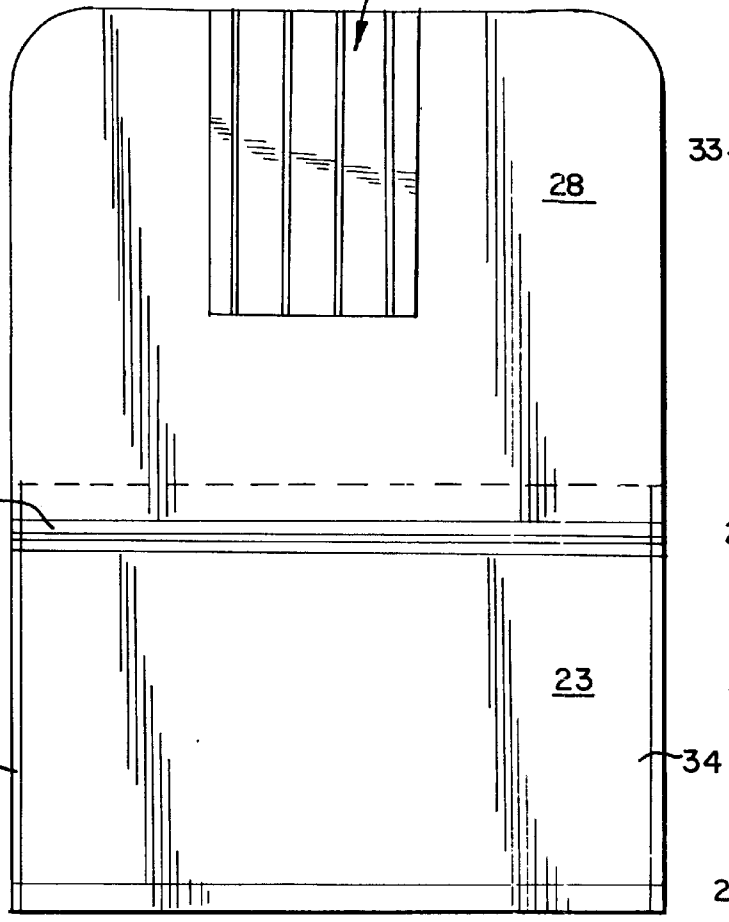
FIG. 7 is a view of an alternative embodiment illustrating the back of the embodiment in elevation and in a fully open and empty condition.
Figure 6:
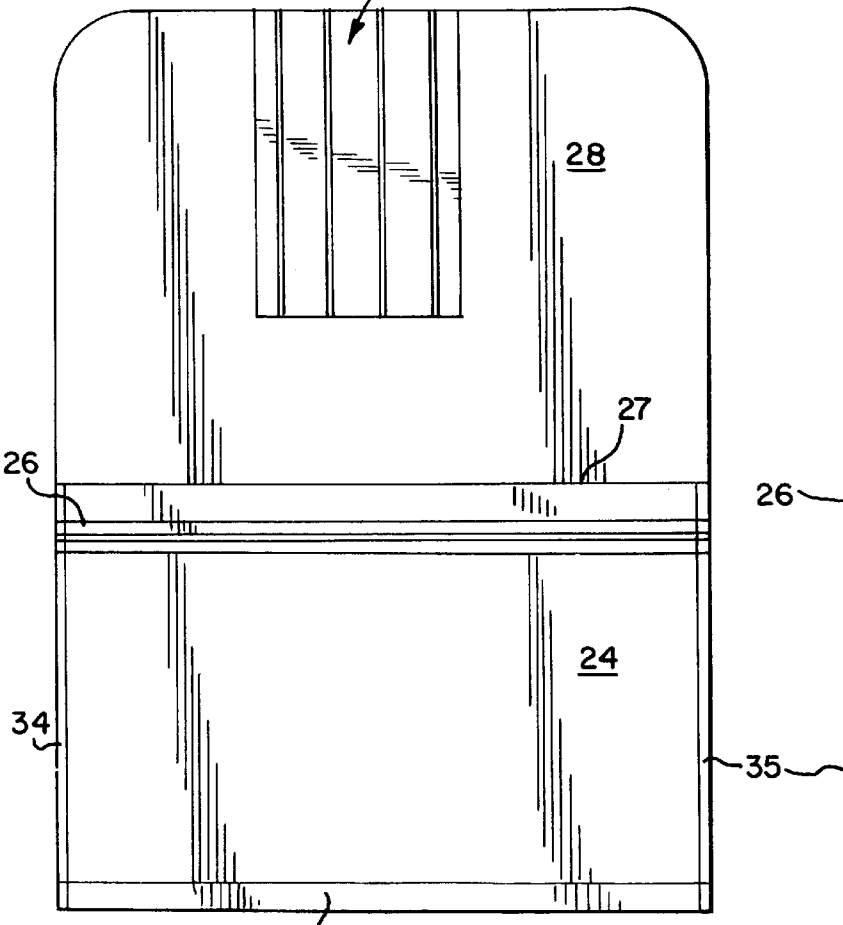
FIG. 6 is an elevational view of the front portion of the pouch as shown in FIG. 1 in a fully open and empty condition.

As illustrated in FIGS. 6 and 7, the deadfold strip 31 has a length which is less than the full height of flexible flap 28 and a width which is less than the full width of flexible flap 28.

It will be appreciated, with all of these embodiments, the advantages of the openable and closeable assembly or zip closure 26 are enjoyed. Additionally, if desired, the mouth 27 can be supplemented by a peelable seal 37 of generally known construction and properties in order to provide a supplemental hermetic seal which provides evidence of tampering or opening of the mouth 27. It will be appreciated that the flexible flap 28 and the deadfold strip(s) are all above or outside of the mouth in order to contribute to the wrap-around securement aspects of the invention.

It will be understood that the embodiments of the present invention which have been described are illustrative of some of the applications of the principles of the present invention. Various modifications may be made by those skilled in the art without departing from the true spirit and scope of the invention.

We claim:

1. A flexible pouch containing a particulate product, comprising:

a flexible, product-confining compartment which is foldable upon itself to define a variety of product-confining volumes and corresponding enclosure heights;

a mouth at one end of the flexible, product-confining compartment;

a selectively openable and closeable assembly on said flexible, product-confining compartment, said selectively openable and closeable assembly being spaced closely inwardly from said mouth to open and close said pouch enclosure generally at said mouth;

a wrap-around flexible flap extending outwardly from said mouth in a direction away from said selectively openable and closeable assembly, said flexible flap having a full height extending between said mouth of the flexible compartment and a free edge of the flexible flap;

a deadfold strip on said wrap-around flexible flap, said deadfold strip having a width less than the full width of said flexible flap;

a supply of particulate product within said flexible compartment, said supply reducing in volume as particulate product is removed from said flexible compartment, thereby reducing said product-confining volume of the compartment; and said wrap-around flexible flap having a reduced height less than said full height thereof, said reduced height being defined between said mouth and a selected bend location along said deadfold strip, said bend location being a location at which the free edge of the flexible flap overlies one surface of said flexible, product-confining compartment while the portion of the flap having the reduced height overlies an opposite surface of said flexible, product-containing compartment.

2. The flexible pouch in accordance with claim 1, wherein said flexible flap is integral with a panel of the flexible, product-confining compartment.

3. The flexible pouch in accordance with claim 1, wherein said flexible flap is a continuous extension of a panel at least partially defining the flexible product-confining compartment.

4. The flexible pouch in accordance with claim 1, wherein said flexible flap has an inside surface and an outside surface on the other side of the flap from the inside surface, said inside surface being on the same side of the pouch as is said mouth.

5. The flexible pouch in accordance with claim 4, wherein said deadfold strip is secured to said inside surface of the flap.

6. The flexible pouch in accordance with claim 4, wherein said deadfold strip is secured to said outside surface of the flap.

7. The flexible pouch in accordance with claim 1, wherein said flexible flap is a laminate including a plurality of sheets, and wherein said deadfold strip includes at least one ductile elongated rod positioned within the laminate.

8. The flexible pouch in accordance with claim 1, wherein said deadfold strip is at least one ductile rod positioned within said wrap-around flexible flap.

9. The flexible pouch in accordance with claim 1, wherein said flexible product-containing compartment, when folded on itself, has an edge generally adjacent to said bend location along the deadfold strip.

10. The flexible pouch in accordance with claim 1, wherein said selectively openable and closeable assembly is a zip closure assembly.

11. The flexible pouch in accordance with claim 1, further including a gusset in the flexible product-confining compartment, said gusset being at a location opposite to that of said mouth.

12. The flexible pouch in accordance with claim 1, wherein said supply of particulate product is a particulate food product.

13. The flexible pouch in accordance with claim 1, wherein said supply of particulate product is a particulate tobacco product.

14. A flexible pouch for containing a particulate product, comprising:

a flexible, product-confining compartment which is foldable upon itself to define a variety of product-confining volumes and corresponding enclosure heights;

a mouth at one end of the flexible, product-confining compartment;

a selectively openable and closeable assembly on said flexible, product-confining compartment, said selectively openable and closeable assembly being spaced closely inwardly from said mouth to open and close said pouch enclosure generally at said mouth;

a wrap-along flexible flap extending outwardly from said mouth in a direction away from said selectively openable and closeable assembly, said flexible flap having a full height extending between said mouth of the flexible compartment and a free edge of the flexible flap;

a deadfold strip on said wrap-along flexible flap, said deadfold strip having a width less than the full width of said flexible flap; and said wrap-along flexible flap has a reduced height less than said full height thereof, said reduced height being defined between said mouth and a selected bend location along said deadfold strip, said bend location being a location at which the free edge of the flexible flap overlies one surface of said flexible, product-confining compartment while the portion of the flap having the reduced height overlies an opposite surface of said flexible, product-containing compartment.

15. The pouch in accordance with claim 14, wherein said flexible flap is integral with a panel of the flexible product-confining compartment.

16. The pouch in accordance with claim 14, wherein said flexible flap is a continuous extension of a panel at least partially defining the flexible, product-confining compartment.

17. The pouch in accordance with claim 14, wherein said flexible flap has an inside surface and an outside surface on the other side of the flap from the inside surface, said inside surface being on the same side of the pouch as is said mouth.

18. The pouch in accordance with claim 17, wherein said deadfold strip is secured to said inside surface of the flap.

19. The pouch in accordance with claim 17, wherein said deadfold strip is secured to said outside surface of the flap.

20. The pouch in accordance with claim 14, wherein said deadfold strip is at least one ductile rod positioned within said wrap-along flexible flap.

21. The pouch in accordance with claim 14, wherein said flexible, product-containing compartment, when folded on itself, has an edge generally adjacent to said bend location along the deadfold strip.

22. The pouch in accordance with claim 14, wherein said selectively openable and closeable assembly is a zip closure assembly.

23. The pouch in accordance with claim 14, further including a gusset in the flexible, product-confining compartment, said gusset being at a location opposite to that of said mouth.

* * * * *